US007462796B1

(12) United States Patent
Chai

(10) Patent No.: US 7,462,796 B1
(45) Date of Patent: Dec. 9, 2008

(54) PUSH BUTTON

(75) Inventor: Chung Chai, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/872,047

(22) Filed: Oct. 15, 2007

(30) Foreign Application Priority Data

Sep. 20, 2007 (CN) ..... 2007 2 0201048 U

(51) Int. Cl.
*H01H 13/70* (2006.01)

(52) U.S. Cl. ..... 200/341; 200/345

(58) Field of Classification Search ..... 200/520, 200/341, 344, 345
See application file for complete search history.

(56) References Cited

U.S. PATENT DOCUMENTS 5,406,277 A * 4/1995 Lee ..... 341/22
5,668,358 A * 9/1997 Wolf et al. ..... 200/5 A
5,938,009 A * 8/1999 Huang ..... 200/517
6,121,564 A * 9/2000 Huang ..... 200/345
6,156,986 A * 12/2000 Tsai ..... 200/345
6,171,003 B1 1/2001 Lo
6,184,481 B1 * 2/2001 Chen ..... 200/5 A
6,969,815 B1 * 11/2005 Lu ..... 200/345
7,102,087 B2 * 9/2006 Chun et al. ..... 200/5 A

* cited by examiner

*Primary Examiner*—Michael A Friedhofer
(74) *Attorney, Agent, or Firm*—Frank R. Niranjan

(57) ABSTRACT

A push button of a computer keyboard includes a cap (10) and a key base (20) attached to cap. The cap includes a cover (12) and a post (14) extending from the cover along a first direction. The post includes a plurality of sidewalls (141) and at least one recessed guideway connected between the adjacent sidewalls. A through hole (28) is defined in the key base for receiving the post of the cap. At least one guide rib (243) is formed on the key base in the through hole. The at least one guide rib is resisted against the corresponding at least one guideway of the post of the cap along two tangent lines parallel to the first direction. The post of the cap is movable along the tangent lines.

15 Claims, 4 Drawing Sheets

PUSH BUTTON

BACKGROUND

1. Technical Field

The present invention relates to push buttons, and more particularly to a push button for a computer keyboard.

2. General Background

A conventional push button on a computer keyboard includes a cap, a key base, and a resilient rubber dome. The cap has a post extending from an underside thereof. The post of the cap is axially movably received in a guide channel defined in the key base, and capable of deforming the rubber dome to contact and trigger an associated circuit to generate a corresponding signal.

In order to prevent deflection of the post of the cap in the guide channel and ensure stable axial movement of the post, sidewalls of the post of the cap are resisted against sidewalls of the guide channel of the key base. However, the post of the cap may not move easily and fluently due to friction between the sidewalls of the post and the sidewalls of the guide channel of the key base.

What is needed, therefore, is a push button having a post capable of moving fluently and easily due to less friction between a cap and a key base thereof.

SUMMARY

A push button of a computer keyboard includes a cap and a key base attached to the cap. The cap includes a cover and a post extending from the cover along a first direction. The post includes a plurality of sidewalls and at least one recessed guideway connected between the adjacent sidewalls. A through hole is defined in the key base for receiving the post of the cap. At least one guide rib is formed on the key base in the through hole. The guide rib is resisted against the corresponding guideway of the post of the cap along two tangent lines parallel to the first direction. The post of the cap is movable along the tangent lines.

Other advantages and novel features will be drawn from the following detailed description of embodiments with attached drawings, in which:

DETAILED DESCRIPTION

Figure 1:
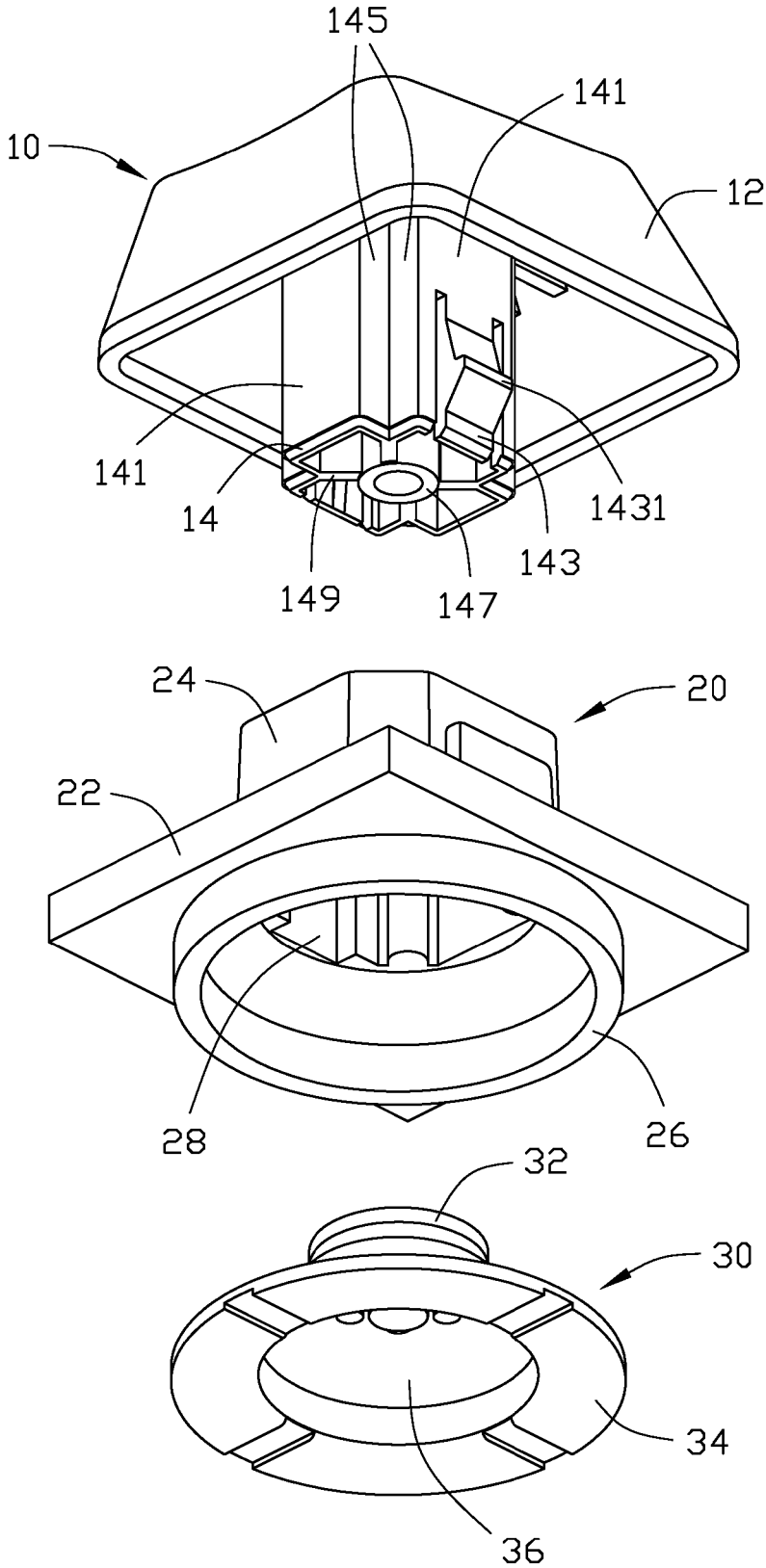
FIG. 1 is an exploded, isometric view of a push button for a computer keyboard in accordance with a preferred embodiment of the present invention.
Figure 2:
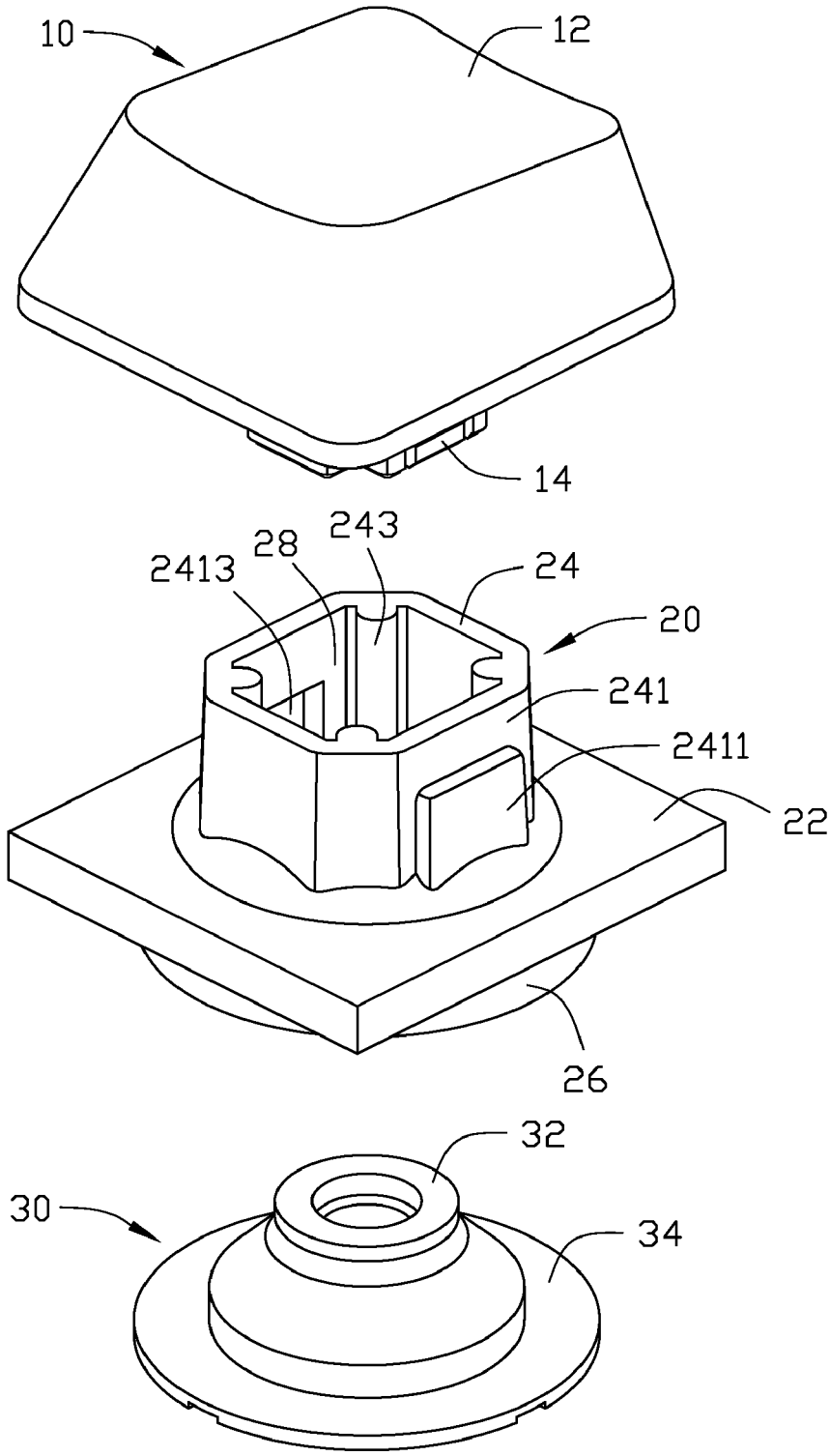
FIG. 2 is similar to FIG. 1, but viewed from another aspect.

Referring to FIG. 1, a push button for a computer keyboard in accordance with an embodiment of the present invention includes a cap 10, a key base 20, and a resilient rubber dome 30.

The cap 10 includes a cover 12 and a post 14 extending from an underside of the cover 12. The post 14 includes two pairs of opposite sidewalls 141. A pair of resilient pieces 143 is formed on one pair of the opposite sidewalls 141 respectively. Each resilient piece 143 has a wedge-shaped hook 1431 formed thereon. The post 14 further includes four guideways connecting between every two adjacent sidewalls 141 at four lengthwise corners thereof. Each guideway includes a pair of recessed panels 145 perpendicularly connecting with each other. Each recessed panel 145 is perpendicularly connected with the adjacent sidewall 141. A central round pillar 147 and four connecting ribs 149 symmetrically arranged around the pillar 147 are formed in a space surrounded by the sidewalls 141 and the recessed panels 145. The connecting ribs 149 are respectively connected between the pillar 147 and conjunction lines of the paired recessed panels 145.

The key base 20 includes a baseboard 22, a case 24 protruding upwards from the baseboard 22, and a ring 26 protruding downwards from the baseboard 22. An axial through hole 28 is defined in the case 24, the baseboard 22, and the ring 26 of the key base 20 for receiving the post 14 of the cap 10. The case 24 includes two pairs of opposite sidewalls 241. A pair of protrusions 2411 is formed on one pair of opposite sidewalls 241, corresponding to the resilient pieces 143 of the post 14 of the cap 10. A pair of recessed hollows 2413 behind the protrusions 2411 is formed in the opposite sidewalls 241 respectively. The distance between every two parallel sidewalls 241 of the case 24 is greater than that between every two parallel sidewalls 141 of the post 14. Four guide ribs 243 are formed in the case 24 at four inner corners of the case 24. The height of each of the guide ribs 243 is equal to the length of each of the sidewalls 241 of the case 24. Each of the guide ribs 243 is semicircular in cross-section.

The rubber dome 30 has a top ring-shaped panel 32 and a bottom ring-shaped panel 34 wider than the top ring-shaped panel 32, leaving a recessed space 36 formed in the bottom portion of the rubber dome 30. The outside diameter of the bottom panel 34 is not less than that of the ring 26 of the key base 20. The outside diameter of the top panel 32 is less than the inside diameter of the ring 26.

Figure 3:
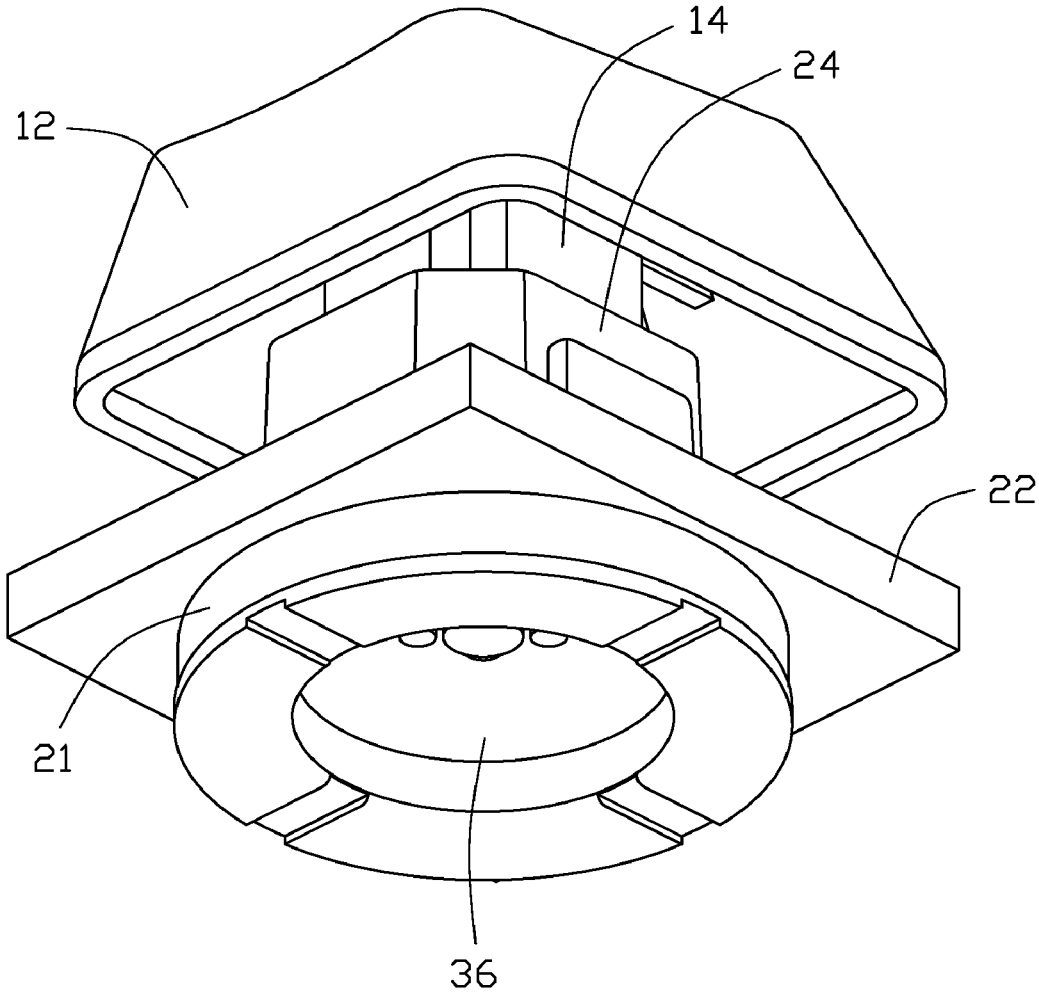
FIG. 3 is an assembled view of FIG. 1.
Figure 4:
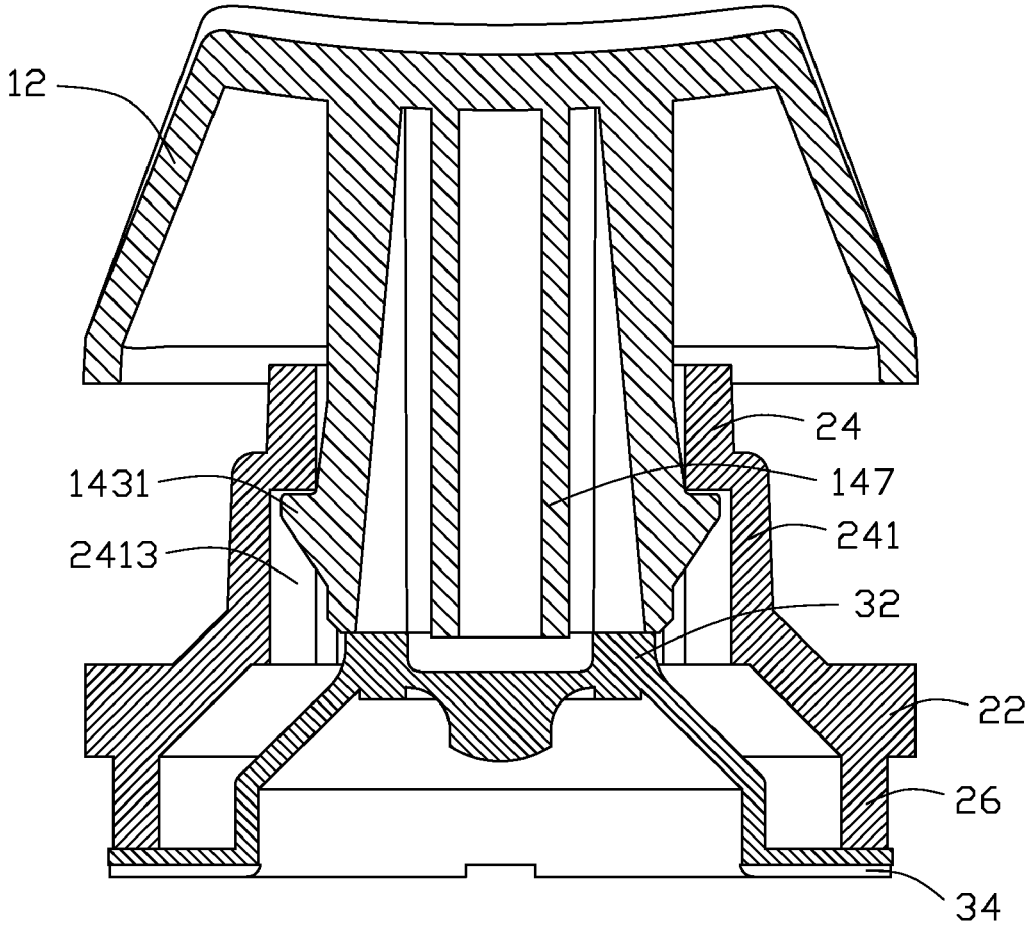
FIG. 4 is a cutaway view of FIG. 3.

Referring also to FIGS. 3 and 4, in assembly, the guideways of the post 14 of the cap 10 are respectively aligned with the guide ribs 243 in the through hole 28. The post 14 of the cap 10 is slid into the through hole 28 of the key base 20 along tangent lines between the recessed panels 145 of the guideways of the post 14 and the guide ribs 243 of the case 24. The resilient pieces 143 of the post 14 of the cap 10 are deformed by the opposite sidewalls 241 of the case 24 until the hooks 1431 engage in the recessed hollows 2413 respectively. Top edges of the recessed hollows 2413 are capable of engaging with the hooks 2413 for preventing upward movement of the post 14 of the cap 10. Then the rubber dome 30 is attached to the ring 26 of the key base 20. The bottom panel 34 of the rubber dome 30 is resisted against a bottom of the ring 26 of the key base 20. The top panel 32 of the rubber dome 30 is inserted into the through hole 28 and touches the round pillar 147 and the connecting ribs 149 of the post 14 of the cap 10 at an original un-depressed state. Thus, the cap 10 and the rubber dome 30 are both attached to the key base 20.

In use, the top cover 12 of the cap 10 is depressed, and the post 14 of the cap 10 moves in the through hole 28 and deforms the top panel 32 of the rubber dome 30 towards the recessed space 36 so as to trigger the associated circuit. Then the cap 10 is released, the top panel 32 of the rubber dome 30 rebounds and elevates the post 14 of the cap 10 to the original un-depressed state.

In the preferred embodiment, the guide ribs 243 of the case 24 are symmetrically resisted against the guideways of the post 14 for preventing deflection of the post 14 and spacing the sidewalls 141 of the post 14 apart from the sidewalls 241 of the case 24. Each of the recessed panels 145 of the guideways of the post 14 contacts the corresponding guide rib 243 along a tangent line. Thus, friction between the post 14 of the cap 10 and the case 24 of the key base 20 is so little that movement of the post 14 in the through hole 28 is unhindered.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A push button, comprising:

a cap comprising a cover and a post extending from the cover along a first direction, the post comprising a plurality of sidewalls and at least one recessed guideway connected between the adjacent sidewalls; and a key base attached to the cap, a through hole being defined in the key base with the post of the cap received therein, the key base having at least one guide rib in the through hole, the at least one guide rib resisting against the corresponding at least one guideway of the post of the cap along tangent lines parallel to the first direction, the post of the cap being movable in the through hole along the tangent lines;

wherein the at least one guideway of the post of the cap comprises a pair of recessed panels connecting with each other and respectively tangent to the at least one guide rib of the key base;

wherein the post of the cap further comprises a round pillar and at least one connecting rib connected between the pillar and a conjunction line of the pair of recessed panels.

2. The push button as described in claim 1, wherein each of the pair of recessed panels of the cap are perpendicularly connected to each other.

3. The push button as described in claim 1, further comprising a rubber dome attached to the key base with a part inserted in the through hole and meeting with the round pillar and the at least one connecting rib of the post.

4. The push button as described in claim 1, wherein the key base defines at least one recessed hollow therein, and the post of the cap comprises at least one hook for engaging in the at least one recessed hollow.

5. The push button as described in claim 1, wherein the key base comprises a plurality of sidewalls apart from the sidewalls of the post of the cap.

6. The push button as described in claim 5, wherein the through hole is surrounded by the sidewalls of the key base, and the at least one guide rib is formed between the adjacent sidewalls of the key base in the through hole.

7. The push button as described in claim 1, wherein the at least one guide rib is arc-shaped in cross-section.

8. A push button, comprising:

a key base, a through hole being defined in the key base;

a cap comprising a cover and a post extending from the cover along a first direction, the post movably received in the through hole in the key base, at least one hook formed on the post and engaging with the key base for preventing disengagement of the post from the key base; and a guiding mechanism formed on the post of the cap and the key base in the through hole, the guiding mechanism comprising at least one pair of recessed panels connecting with each other, and at least one guide rib corresponding to said at least one pair of recessed panels, the at least one pair of recessed panels being both tangent to the at least one guide rib along tangent lines parallel to the first direction;

wherein the post of the cap comprises a round pillar and at least one connecting rib connected between the pillar and a conjunction line of the pair of recessed panels.

9. The push button as described in claim 8, wherein the at least one pair of recessed panels of the guiding mechanism are perpendicularly connected to each other.

10. The push button as described in claim 8, wherein the at least one guide rib is formed on the key base in the through hole, and the at least one pair of recessed panels are integrally formed in the post of the cap.

11. The push button as described in claim 10, wherein the post of the cap comprises sidewalls connecting with the at least one pair of recessed panels and is set apart from the key base in the through hole.

12. The push button as described in claim 10, wherein each of the at least one pair of recessed panels is perpendicularly connected with the adjacent sidewall of the post.

13. The push button as described in claim 8, wherein the key base defines at least one recessed hollow therein, the at least one hook of the cap is engaged in the at least one recessed hollow.

14. The push button as described in claim 13, wherein the post of the cap further comprises at least one resilient piece, the at least one hook is formed on the corresponding at least one resilient piece.

15. The push button as described in claim 8, further comprising a rubber dome attached to the key base with a part inserted in the through hole and meeting with the round pillar and the at least one connecting rib of the post.

* * * * *